United States Patent [19]

Graser

[11] Patent Number: 4,469,222

[45] Date of Patent: Sep. 4, 1984

[54] TWO-PIECE BEVERAGE CARRIER

[75] Inventor: Earl J. Graser, Monroe, La.

[73] Assignee: Manville Service Corporation, Denver, Colo.

[21] Appl. No.: 349,800

[22] Filed: Feb. 18, 1982

[51] Int. Cl.[3] ..... B65D 75/00

[52] U.S. Cl. ..... 206/180; 206/143; 206/178; 206/427; 206/200; 229/28 BC; 229/52 BC

[58] Field of Search ..... 206/140, 141, 162, 166, 206/174, 175, 176, 180, 188, 200, 178, 427, 429; 229/28 BC, 52 BC

[56] References Cited

U.S. PATENT DOCUMENTS

| | | | |
|---|---|---|---|
| Re. 29,063 | 12/1976 | Graser | 206/141 |
| 2,419,842 | 4/1947 | Lebold | 206/162 |
| 2,609,137 | 9/1952 | Toensmeier | 206/166 |
| 2,665,049 | 1/1954 | George | 206/200 |
| 2,686,003 | 8/1954 | Forrer | 206/162 |
| 2,742,182 | 4/1956 | Hickin et al. | 206/200 |
| 2,755,964 | 7/1956 | Ringler | 206/176 |
| 3,008,605 | 11/1961 | Uesak | 206/166 |
| 3,107,811 | 10/1963 | Lemon | 206/166 |
| 3,111,241 | 11/1963 | Engel | 206/166 |
| 3,355,012 | 11/1967 | Weiss | 206/200 |
| 3,402,849 | 9/1968 | Matthews et al. | 206/176 |
| 3,531,042 | 9/1970 | Atkinson | 206/166 |
| 3,825,171 | 7/1974 | Dewhurst | 206/166 |
| 3,949,870 | 4/1976 | Graser | 206/141 |
| 4,007,830 | 2/1977 | Calvert | 206/175 |
| 4,153,158 | 5/1979 | Graser et al. | 206/188 |

FOREIGN PATENT DOCUMENTS

| | | | |
|---|---|---|---|
| 927800 | 6/1973 | Canada | 206/162 |

*Primary Examiner*—Joseph Man-fu Moy
*Assistant Examiner*—David Fidei
*Attorney, Agent, or Firm*—Ronald M. Halvorsen; John D. Lister

[57] ABSTRACT

A two-piece beverage carrier is disclosed comprising a one-piece folded longitudinal partition insert which is adhesively secured to the end panels and to the bottom panel of a separate paperboard shell. The shell may be constructed as a wrap-around carrier or it may be constructed in the form of a basket style. The insert for either type of shell has formed thereon a plurality of transverse butterfly partition panels which also have formed thereon glue tabs for adhesively securing the buterfly partitions to the side panels of the paperboard shell. The insert utilizes a low caliber, single thickness of paperboard information of the production blank and by the structure and outline of the butterfly partition panels, heavier thickness is obtained between cells of the erected carrier.

2 Claims, 10 Drawing Figures

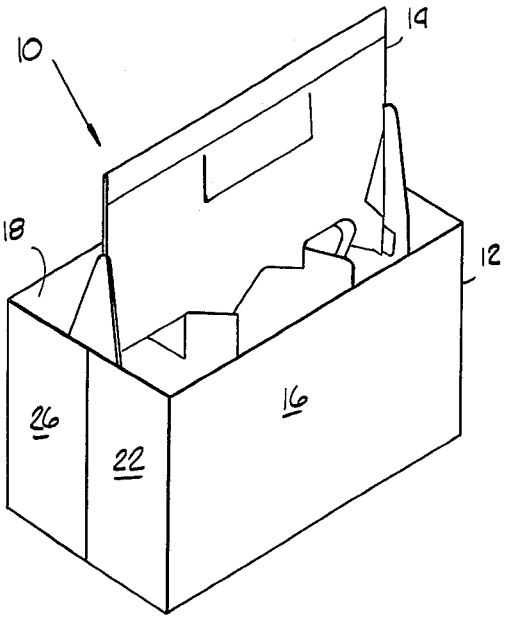
Fig. 1.
Fig. 2.
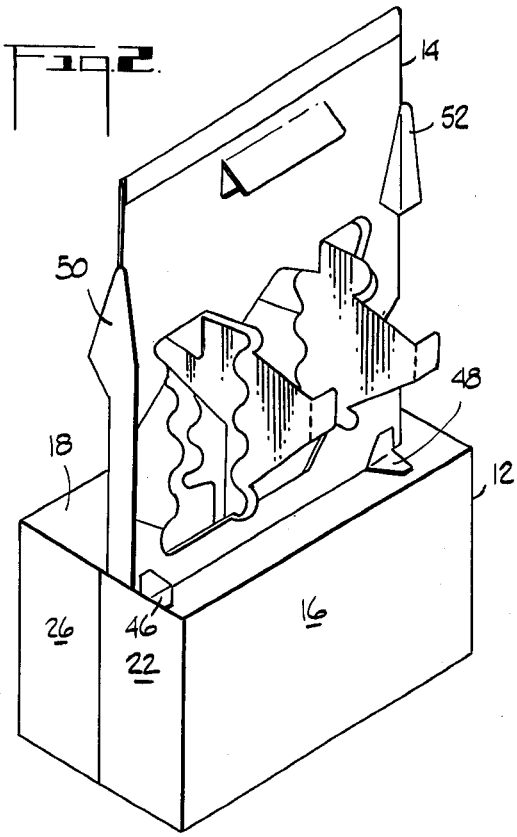
Fig. 3.
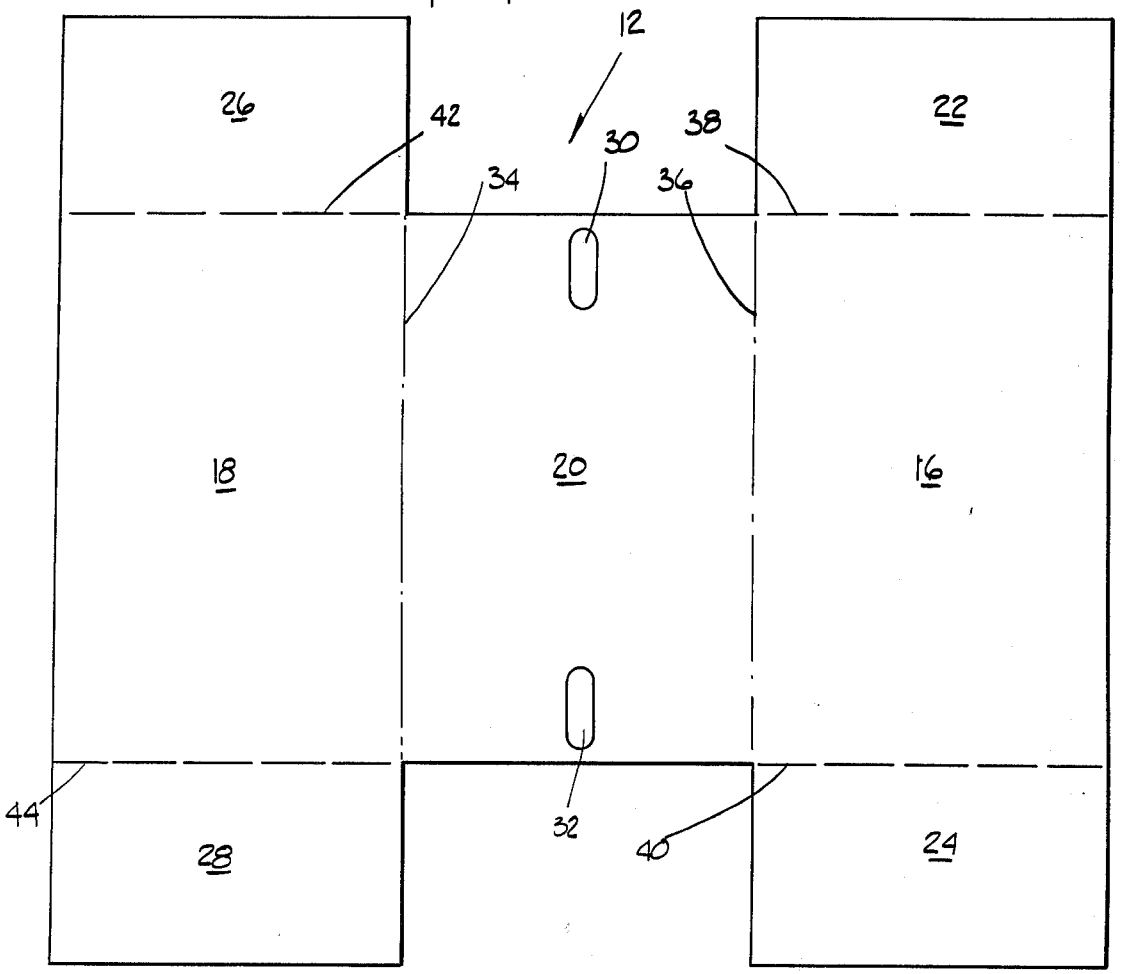

226
230
226
218
234
234
220
188
188
268
264
268
210
236
260
212
202
204
256
258
240
246
242
194
268
268
262
196
266
244
190
186
192
192
252
200
254
198
248
250
208
206
216
238
214
224
234
188
222
188
234
238
232
228

TWO-PIECE BEVERAGE CARRIER

BACKGROUND OF THE INVENTION

This invention relates to basket style beverage carriers and more particularly a unique two-piece beverage carrier designed to be used with low caliber, single thickness of paperboard and having double thickness separation between adjacent cells in the interior partition.

It is desirous in the formation of a basket style beverage carrier to provide double thickness or more separation between adjacent cells in the carrier. Previous carriers utilized heavier caliber paper to obtain this separation and also would be formed from various unique designs of the production blank having intricate fold overs and having at times separate pieces of paperboard laminated to each other in order to obtain the necessary thickness and strength in the carrier.

Such carriers many times required also intricate machines be developed in order to obtain the necessary machinery for folding the many parts of the carrier.

SUMMARY OF THE INVENTION

In order to overcome problems inherent in many of the prior art basket style carriers, there has been provided by the subject invention a new and improved two-piece beverage carrier formed from the combination of a generally rectangular shaped shell structure which is formed without a central partition and other partition elements. The shell structure has positioned therein a one-piece folded longitudinal partition insert which is adhesively secured to the end panels and to the bottom panel of the shell structure. A plurality of transverse butterfly partition panels are formed in the longitudinal partition insert to provide separation between adjacent cells in the basket carrier with the butterfly partition panels also being adhesively secured to the side panels of the carrier. The shell structure may be constructed as a wrap-around carrier or it may be constructed in the form of a basket style.

The use of a one-piece folded longitudinal partition insert provides double thickness paperboard longitudinally in the erected carrier and also the use of the novel transverse butterfly partition shapes provide double thickness partition separation between the transverse partitions in the carrier.

Accordingly, it is an object and advantage of the invention to provide a new and novel two-piece beverage carrier which is formed from a simplified shell having a simplified partition insert glued into the shell.

Yet another object and advantage of the invention is to provide a new and novel two-piece beverage carrier capable of providing double thickness separation thereby allowing lower caliber paperboard to be used in the partition element of the carrier.

Still yet another object and advantage of the invention is to provide a new and novel partition insert having a unique structural design which allows double partition thickness between adjacent cells of the carrier utilizing the novel structural shape taught herein.

These and others objects and advantages of the invention will become apparent from a review of the drawings attached to the Description of the Preferred Embodiment all forming a part of the specification of the Applicant's invention.

BRIEF DESCRIPTION OF THE DRAWINGS

FIG. 1 is a perspective view of the Applicant's new and novel two-piece beverage carrier when formed as a basket style carrier;

FIG. 2 is an exploded perspective view of the Applicant's new and novel two-piece basket style beverage carrier showing the one-piece separate partition being positioned into the open ended shell of the carrier;

FIG. 3 is a plan view of the production blank of the open ended shell forming a part of the Applicant's beverage carrier;

DESCRIPTION OF THE PREFERRED EMBODIMENT

Figure 4:
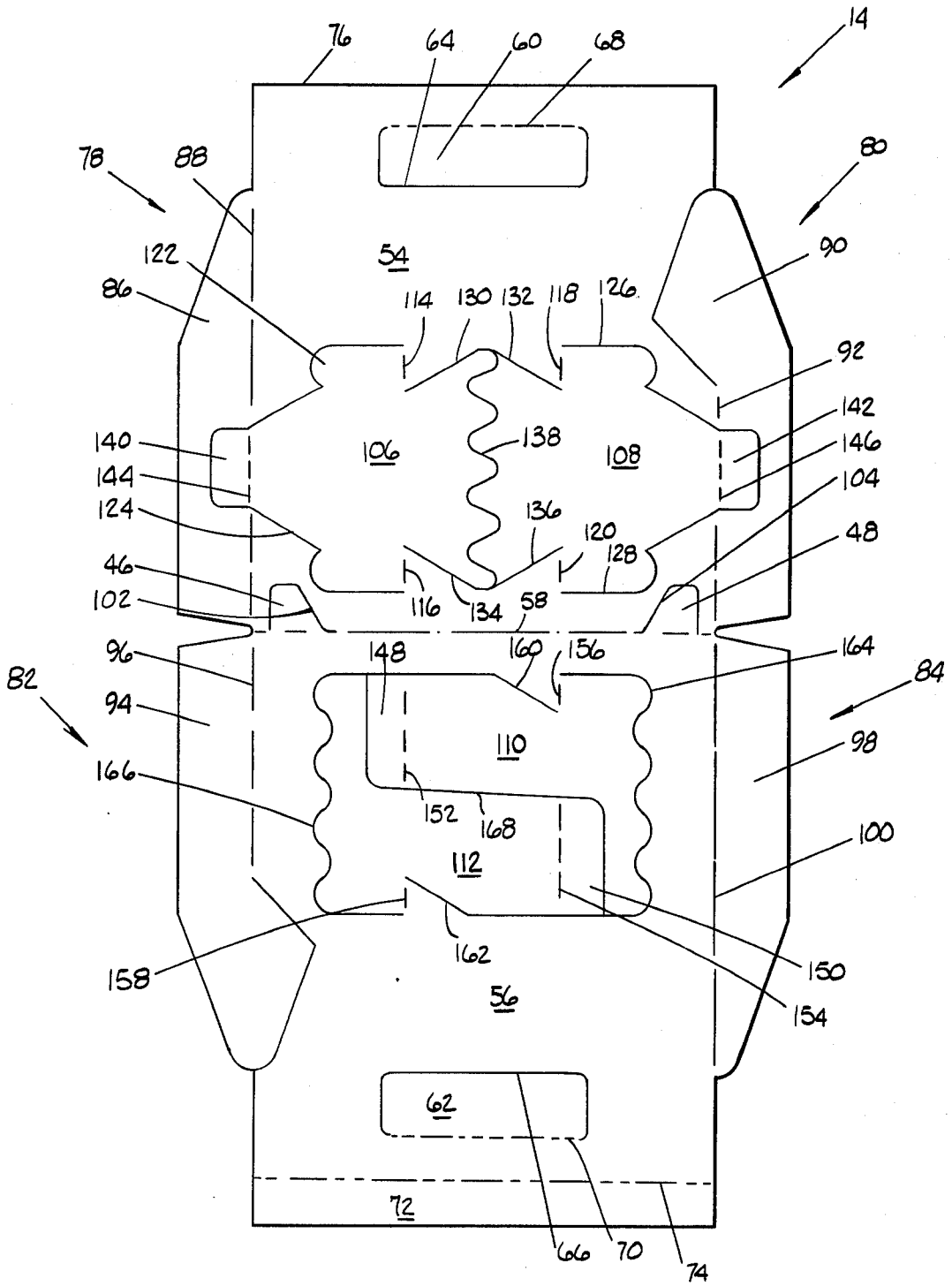
FIG. 4 is a production blank of the partition insert used in the Applicant's beverage carrier and showing the novel shape of the butterfly partitions forming a part of the Applicant's invention.

Referring now to the drawings in general and in particular to FIG. 1 of the drawing, there is shown one form of the Applicant's new and novel two-piece basket style beverage carrier generally by the numeral 10 which comprises a generally rectangular shaped open ended shell 12 and a one-piece folded longitudinal partition insert 14.

The shell structure 12 comprises a pair of side walls 16 and 18 hingedly attached to a bottom wall 20 (not shown in FIG. 1 of the drawings). Each side wall 16 and 18 contains end walls or panels 22, 24, 26 and 28. The structure of the open ended shell is shown more clearly in FIG. 3 of the drawing and it can be seen by referring to FIGS. 1 and 3 simultaneously that the end walls 22 and 26 would be adhesively secured together while the end walls 24 and 28 would also be adhesively secured together to form the open ended shell structure. It is within the spirit and scope of the invention that the production blank for the open ended shell could be formed with only one end wall spanning the entire end of the carrier instead of two end walls on each end of the carrier adhesively secured together.

The bottom wall of panel of the open ended shell 20 as shown in FIG. 3 contains at least two slots 30 and 32 whose purpose will be described more fully hereinafter. It can be seen also by referring to FIG. 3 that the side walls 16 and 18 are hingedly attached to the bottom wall 20 by means of the score line 34 and 36 while the end walls 22 and 24 are hingedly attached to the side walls 16 by means of the score lines 38 and 40. In a similar manner, the end walls 26 and 28 are hingedly attached to the side wall 18 by means of the score lines 42 and 44.

Referring now to FIG. 2 of the drawing, there is shown an exploded perspective view of the Applicant's two-piece basket style beverage carrier showing the one-piece partition insert 14 being positioned into the open ended shell 12 as has been beforementioned. It can be seen in FIG. 2 that the partition insert 14 has a pair of downwardly positioned tabs 46 and 48 which are designed to be inserted in the slots 30 and 32 and to be adhesively secured to the underside of the bottom wall or panel 20. It can also be seen that the partition insert 14 contains a pair of end wall tabs 50 and 52 which are adhesively secured to the inside of the end walls 22 and 24 and to the inside of the end walls 26 and 28 to thoroughly fix the separate one-piece partition insert into the open ended shell 12.

Referring now to FIG. 4 of the drawing, there will be described in detail the structure of the one-piece folded longitudinal partition insert 14 which comprises a first panel 54 hingedly attached to a second panel 56 by means of a centrally positioned score line 58. The first panel 54 as well as the second panel 56 have formed thereon handle means in the forms of a handle tab 60 and 62 formed by means of the die cuts 64 and 66 as well as the score line 68 and 70.

One of the panels 54 or 56 cntains a handle reinforcing glue panel for overlapping with the other panel whenever the partition insert is folded and laminated together. In the embodiment shown in FIG. 4, the second panel 56 contains the handle reinforcing glue panel 72 formed by means of the score line 74. When formed thusly, it will be seen that the handle reinforcing glue panel is folded over and overlaps the top of the first panel 54 in the area between the edge 76 and the score line 68 forming the handle tab 60 in order to provide triple thickness reinforcement at that portion of the partition insert.

The first panel 54 contains first glue means shown generally by the arrows 78 and 80 on each side of the panel. In a similar manner, the second panel 56 contains second glue means hingedly attached to the second panel for gluing the second panel to the shell. The second glue means is shown generally by the numerals 82 and 84 and are formed on each side of the panel. The first glue means 78 comprises a glue tab 86 hingedly attached to one side of the first panel 54 by means of the score line 88. The other first glue means 80 formed on the other side of the first panel 54 comprises a glue tab 90 hingedly attached to the first panel 54 by means of the score line 92.

In a similar manner, the second glue means 82 is formed by means of a glue tab 94 hingedly attached to the second panel 56 by means of the score line 96. The other second means 84 formed on the other side of the second panel 56 is formed from a glue tab 98 hingedly attached to the second panel 56 by means of the score line 100. When formed thusly, the glue tab 86 would be adhesively secured to the glue tab 94 and the glue tab 98 would be adhesively secured to the glue tab 90. Thereafter, these groups of glue tabs would be folded along their respective score lines 88 and 96 as well as the score lines 92 and 100 to be positioned for insertion into the open ended shell 12 as shown in FIG. 2 of the drawing and for being adhesively secured to the end walls 22, 24, 26 and 28.

As has been beforementioned, a pair of bottom panel glue tabs 46 and 48 are formed on the partition insert 14 and in the embodiment shown in FIG. 4 are formed out of the first panel 54 by means of the die cuts 102 and 104, with the tabs being hinged along the score line 58.

The first panel 54 has hingedly attached thereto a pair of first shaped butterfly partitions 106 and 108 while the second panel 56 has hingedly attached thereto a pair of second shaped butterfly partitions 110 and 112. The first shaped butterfly partitions 106 and 108 are hingedly attached to the first panel 54 by means of the score lines 114, 116, 118 and 120 and are cut out of the first panel 54 by means of the irregular shaped die cuts 122, 124, 126 and 128 as well as the irregular die cuts 130, 132, 134, 136 and 138.

It can be seen in referring to FIG. 4, that the first shaped butterfly partitions 106 and 108 have formed thereon glue tabs 140 and 142 by means of the score lines 144 and 146. It can also be seen that the second shaped butterfly partitions 110 and 112 have formed thereon glue tabs 148 and 150 by means of the score lines 152 and 154. The second shaped butterfly partitions 110 and 112 are formed out of the second panel 56 by means of the score lines 156 and 158 in combination with the die cuts 160 and 162 as well as the irregular shaped die cuts 164 and 166 and the elongated, irregular shaped die cut 168.

When formed thusly, the first shaped butterfly partitions 106 and 108 may be pivoted 90° out of the plan of the first panel 54 while the second shaped butterfly partition elements 110 and 112 may be pivoted out of the plan of the second partition panel 56 by 90° to lie in juxtaposition with the first shaped butterfly partition elements as will be described more fully hereinafter, especially when referring to drawings FIGS. 5–7 of the drawing.

Figure 5:
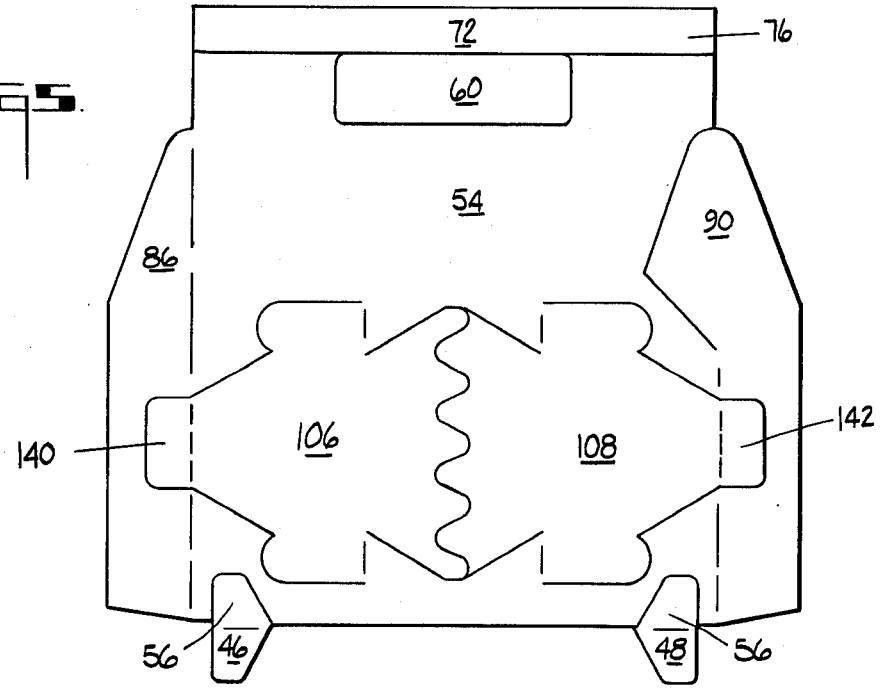
FIG. 5 is a side view of the production blank shown in FIG. 4 showing it folded in half along a central score line.
Figure 6:
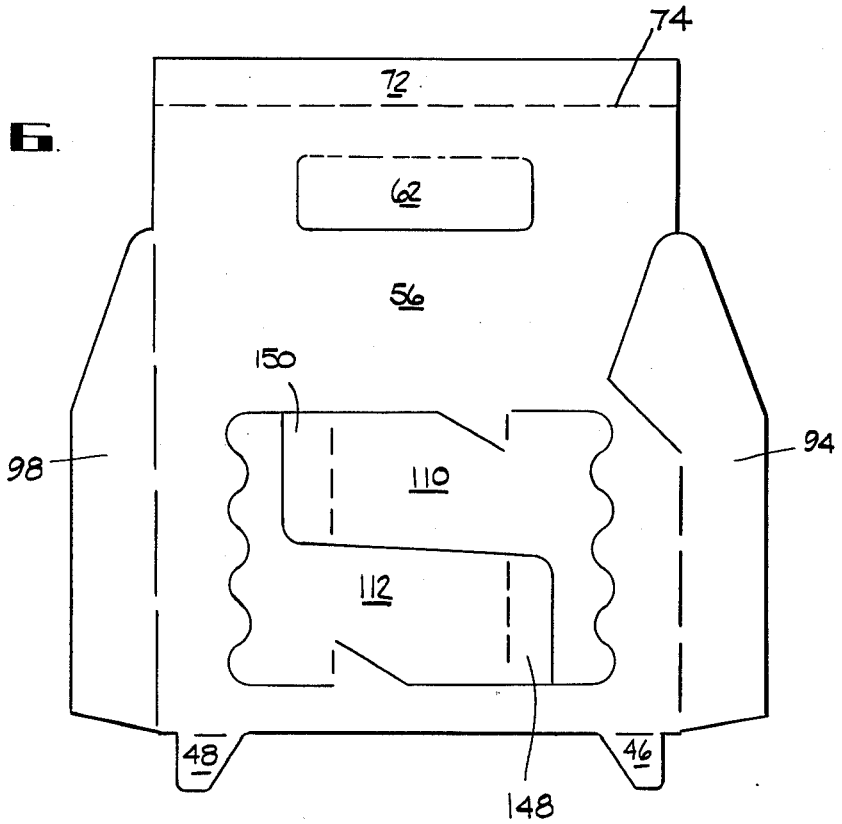
FIG. 6 is the other side view of the folded partition insert shown in FIG. 5 showing the opposite butterfly partition elements.

Referring now to FIGS. 5 and 6 of the drawing, there is shown the production blank of the partition shown in FIG. 4 as it would be folded and adhesively secured together prior to folding the first shaped butterfly partitions 106 and 108 and the second shaped butterfly partitions 110 and 112 by 90° out of the plan of the first panel 54 and the second panel 56. FIG. 5 represents a side view of the folded partition insert adhesively secured to the other half of the partition insert with the reinforcing panel 72 turned down and glued. FIG. 6 represents a side view looking at the opposite side of the partition insert but showing the reinforcing panel 72 prior to its being turned down along score line 74. It can be seen in FIG. 5 how the bottom panel glue tabs 46 and 48 would then be turned downwardly out of the first panel 54 ready for insertion in the slots 30 and 32 in the open ended shell 12.

Figure 7:
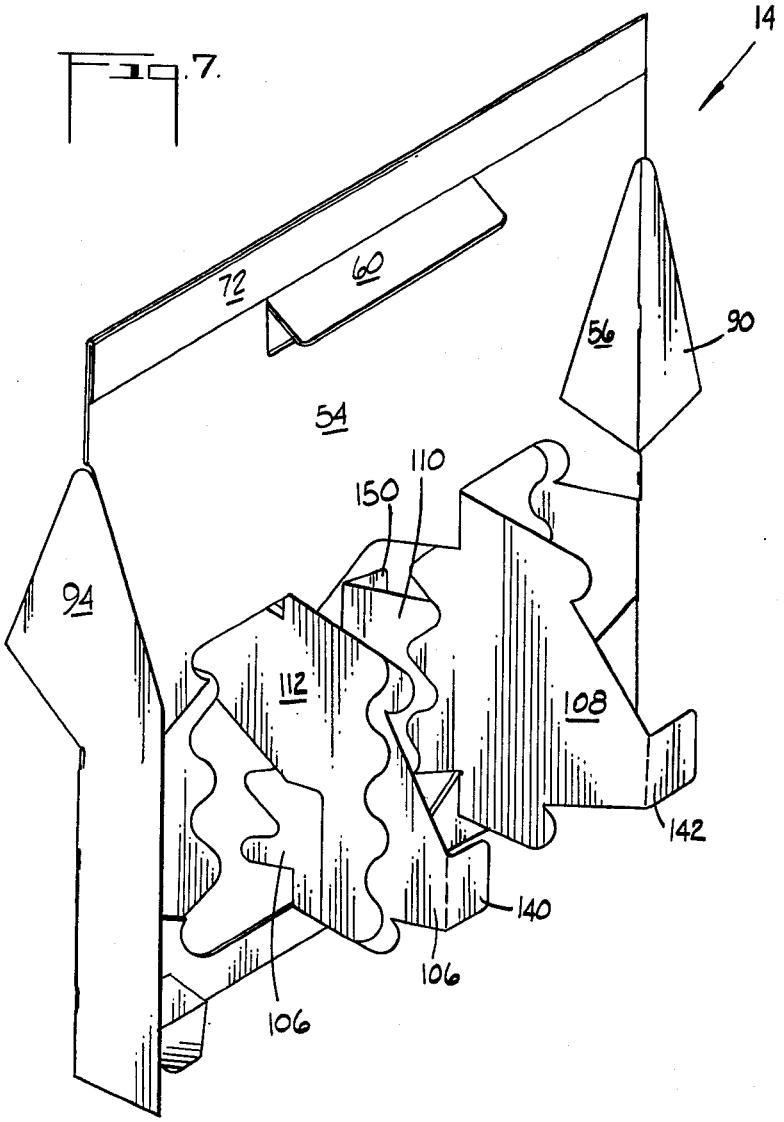
FIG. 7 is a perspective view of the folded partition insert shown in FIGS. 5 and 6 showing the butterfly panels folded outwardly and showing the partition in a position to be inserted into the shell as is shown in FIG. 2 or FIG. 9 of the drawing.
Figure 9:
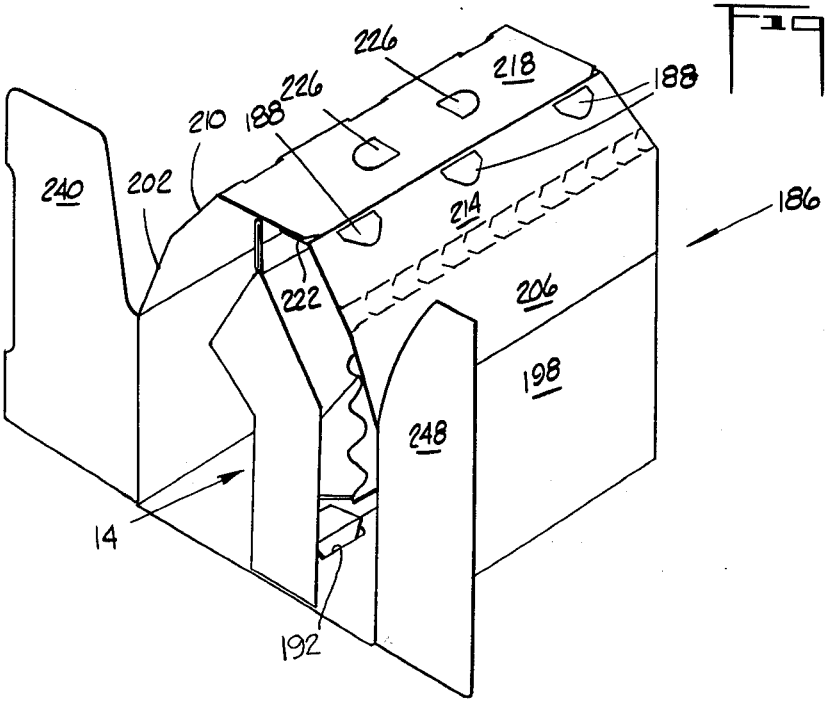
FIG. 9 is a perspective view of the shell structure when formed as a wrap-around carrier.

Referring now to FIG. 7 of the drawing, there is shown an enlarged perspective of the folded partition insert showing each of the first and second shaped butterfly partitions being folded 90° out of the plan of either the first panel 54 or the second panel 56 and after they have been adhesively secured to each other as will be described more fully hereinafter when referring to FIG. 8 of the drawing. It can be seen in FIG. 7 how the glue tab 94 has been folded after having the glue tab 86 adhesively secured thereto and it can also be seen how the glue tab 90 has been folded after having had the glue tab 98 adhesively secured thereto. It can also be seen in FIG. 7 how the first shaped butterfly partition 106 is adhesively secured to the second shaped butterfly partition 112 and also how the first shaped butterfly partition 108 is adhesively secured to the second shaped butterfly partition 110. When formed, folded and adhesively secured together as shown in FIG. 7 of the drawing, it can be seen that the partition insert 14 is ready for insertion into the open ended shell 12 as shown in FIG. 2 of the drawing and may also be inserted into the wrap-around carrier shell as shown in FIG. 9. It should be noted, however, that in FIG. 2 end wall tab 50 is the glue tab 94 shown in FIG. 7 and the end wall tab 52 shown in FIG. 2 is the glue tab 90 shown in FIG. 7. When inserted into the open ended shell 12, the partition insert 14 would have the glue tabs 140 and 142 adhesively secured to the side wall 16 while the glue tabs 148 and 150 would be adhesively secured to the side wall 18 of the open ended shell 12.

Figure 8:
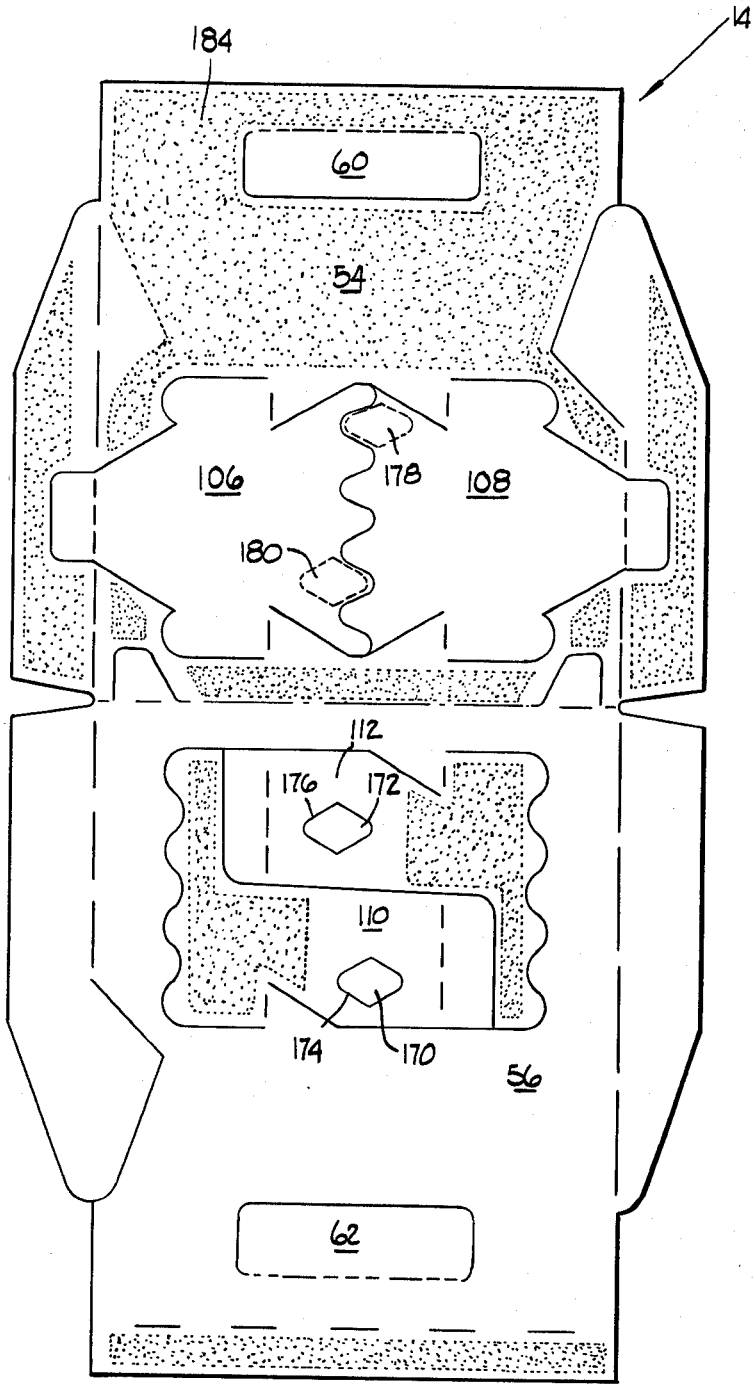
FIG. 8 is a plan view of a modified form of the production blank shown in FIG. 4 showing the means for obtaining double thickness bottle separation both at the top of the individual cells and at the bottom of the individual cells in the basket style carrier.

Referring now to FIG. 8 of the drawing, there is shown a modified production blank of the Applicant's novel partition insert which has been modified as will be described hereinafter. It should be noted that the production blank shown in FIG. 8 is identical to the production blank shown in FIG. 4 with the exception of the addition of a plurality of diamond shaped glue buttons 170 and 172. The glue buttons 170 and 172 are formed by means of the die cuts 174 and 176 and are formed in the second shaped butterfly partitions 110 and 112 as shown in FIG. 8 of the drawing. Whenever the partition insert 14 is folded in the manner previously described, it will be observed that the glue buttons 170 and 172 will be transferred to the opposite first shaped butterfly partitions 108 and 106 and positioned where shown by the dotted sections 178 and 180. This transfer would be accomplished in the folding machine after a pre-determined amount of adhesive would be applied to the glue buttons 170 and 172 and they would be then pushed from their die cut 174 and 176 by a pushing finger and would be positioned on the opposite first shaped butterfly partitions 106 and 108. When positioned thusly, it will be observed that the positioning of the glue buttons 170 and 172 then allows double thickness partition separation at both the upper and lower portions of the butterfly shaped partitions due to the particular shapes of the various butterfly partitions 106, 108, 110 and 112.

It can also be seen in FIG. 8 how the adhesive 184 (shown stippled) has been applied to the respective portions of the partition insert 14 in order to adhere the various parts to each other as has been previously described and as has been shown in the drawings.

Figure 10:
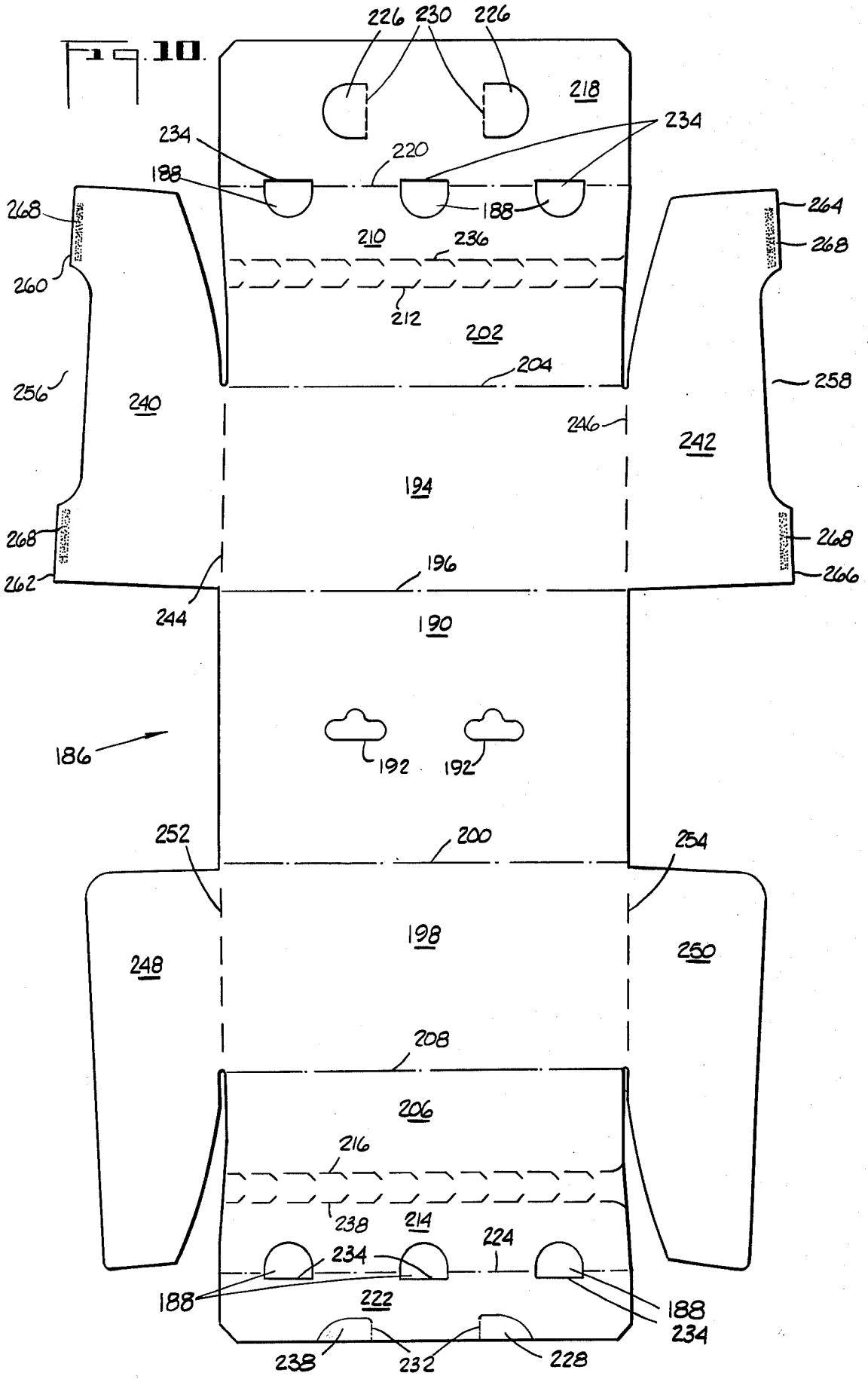
FIG. 10 is a plan view of the shell structure shown in FIG. 9.

Referring now to FIGS. 9 and 10 of the drawings, there is shown the Applicant's novel two-piece beverage carrier when formed as a wrap-around type carrier. In the embodiment shown in FIGS. 9 and 10, it can be seen that the carrier is formed with an outer wrap-around style shell shown generally by the numeral 186 which is formed without a central partition element 14 of the type shown in FIG. 4 of the drawing. The shell 186 is formed from the production blank shown in FIG. 10 of the drawing and would be designed to have positioned therein the partition 14 shown in FIG. 14 whenever the shell 186 was erected and bottles positioned within the partition element. In FIG. 9 of the drawing, one end of the shell has been left open in order to show how the partition element 14 has been positioned within the shell. It should also be apparent by referring to FIG. 9 how the partition insert 14 would be adhesively secured to the end panels of the wrap-around shell as will be further described hereinafter and also to the bottom panels. When formed thusly and positioned within the shell 186, the partition element 14 would also have a plurality of bottles (not shown in the drawings) positioned within the partition so that their necks would be positioned through a plurality of bottle neck receiving openings 188 as will also be more fully described hereinafter when referring to FIG. 10 of the drawings.

Referring now to FIG. 10 of the drawing, there is shown the wrap-around style outer shell 186 of the Applicant's invention which comprises a generally rectangular shaped bottom panel 190 having formed thereon on opposite sides thereof at least two slots 192. The slots 192 are designed to receive the gluing tabs 46 positioned on the partition insert 14 as shown in FIG. 4 of the drawing. A first side panel 194 is hingedly attached to one side of the bottom panel 190 by means of the score line 196. In a similar manner, another first side panel 198 is hingedly attached to the other side of the bottom panel 190 by means of the score line 200. A second side panel 202 is hingedly attached to the first side panel 194 by means of the score line 204. In a similar manner, a second side panel 206 is hingedly attached to the first side panel 198 by means of the score line 208. A first top panel 210 is hingedly attached to the second side panel 202 by means of the score line 212 and in a similar manner, a first top panel 214 is hingedly attached to the second side panel 206 by means of the score line 216.

A second top panel 218 is hingedly attached to the first top panel 210 by means of the score line 220. A third top panel 222 is hingedly attached to the first top panel 214 by means of the score line 224.

Handle means are formed in the second top panel 218 and in the third top panel 222 by means of a pair of tabs 226 and a pair of tabs 228. The tabs 226 are formed by means of the score lines 230 and the tabs 228 are formed by means of the score lines 232.

A plurality of bottle neck receiving openings 188 are formed partially in the first top panel 214 and in the third top panel 222 and are also formed partially in the first top panel 210 and the second top panel 218. The neck receiving openings 188 are designed for receiving the necks of bottles to be contained in the carrier with the bottle caps being designed to be positioned against the edge 234 of the neck receiving openings 188.

Tear means are formed on at least one of the top panels for tearing the top panels from the carrier to expose the bottles to be contained in the carrier which will be positioned within the partition elements 14. The tear means in the embodiment shown in FIG. 10 is formed by means of the score line 236 formed in proximity to the score line 212 and also is formed by means of the score line 238 formed in proximity to the score line 216. When formed thusly, these score lines are used to tear out a portion of the first top panels 210 and/or 214 in order to be able to remove the top from the carrier.

The production blank of the wrap-around shell 186 also contains a pair of end panels 240 and 242 hingedly attached to the first side panel 194 by means of the score line 244 and 246. In a similar manner, the first side panel 198 also has hingedly attached thereto a pair of end panels 248 and 250 by means of the score line 252 and 254. It can also be seen in FIG. 10 how the end panels 240 contain a cut-out area 256 and 258 forming a pair of end flaps 260, 262, 264 and 266. It should become apparent that a quantity of adhesive 268 would be applied to the end flaps in order to adhesively secure the adjacent end flap thereto. The adhesive is shown stippled in FIG. 10.

By referring to FIGS. 9 and 10, it can be seen then that the end flap 240 would be adhesively secured to the end flap 248 by means of the end flaps 268. In a similar manner, the end panel 242 would be adhesively secured to the end panel 250 by means of the end flaps 268 formed on that panel.

When the partition insert 14 is inserted in the wrap-around shell 186, it should become apparent that the glue tabs 140 and 142 as well as the glue tabs 148 and 150 would be adhesively secured to one of the side panels while the glue tabs 90 and 94 would be secured to one of the end panels depending on which way the partition insert were positioned in the carrier. When inserted thusly, the glue tabs 46 and 48 on the partition insert 14 would be inserted in the slots 192 on the bottom panel 190 and would be adhesively secured to the underside of the bottom panel 190 after having applied thereto a predetermined quantity of adhesive.

From the foregoing there has been provided by the subject invention a new and novel two-piece beverage carrier formed from a generally rectangular shaped shell and having a one-piece folded separate longitudinal partition insert which is adhesively secured into the shell to provide double wall protection at the various portions of the cell structure due to the novel shapes of the particular butterfly partitions forming the cell structure. It can be observed that many changes may be made in the arrangement of the various parts and the particular structure shapes in order to accomplish the objects of the invention and the spirit and scope of the invention is not to be defeated by making these changes. The embodiment shown has been given by way of illustration only.

Having described my invention, I claim:

1. A two-piece basket style beverage carrier formed from paperboard comprising:

(a) a generally rectangular shaped open top shell comprising a bottom panel, a pair of side panels and a pair of end panels; the bottom panel having a plurality of tab receiving openings on opposite ends thereof; and (b) a partition insert comprising a first insert panel and a second insert panel adhesively laminated together, the partition insert having handle means and extending longitudinally between the end panels of the shell, each insert panel having glue tabs at each end adhesively secured to the shell end panels and the insert panels having a pair of glue tabs extending through the openings in and adhesively secured to the shell bottom panel; the first insert panel having a first pair of butterfly partitions hingedly attached to the first insert panel along vertical score lines and extending perpendicular to the plane of the first insert panel, the score lines being located intermediate the ends the first pair of butterfly partitions with a shorter section of each of the first butterfly partitions extending transversely from the first insert panel toward one of the shell side panels and a longer section of each of the first butterfly partitions extending transversely from the first insert panel toward the opposite shell side panel, the longer sections of the first butterfly partitions being adhesively secured to at least one of the shell side panels by a first pair of butterfly partition glue tabs; the second insert panel having a second pair of butterfly partitions hingedly attached to the second insert panel along vertical score lines and extending perpendicular to the plane of the second insert panel, the score lines being located intermediate the ends of the second pair of butterfly partitions with a shorter section of each of the second pair of partitions extending transversely from the second panel toward one of the shell side panels and a longer section of each of the second pair of butterfly partitions extending transversely from the second panel toward the opposite shell side panel, the longer sections of the second butterfly partitions being adhesively secured to at least one of the shell side panels by glue tabs, the long sections of the second pair of partitions being substantially one half the height of the short sections, the first pair of butterfly partitions and the second pair of butterfly partitions being adhesively laminated together with the short sections of each set of partitions adhesively secured to the long sections of the other set of butterfly partitions.

2. The two-piece basket style beverage carrier of claim 1 wherein: the first pair of butterfly partitions have substantially the same shape extending in opposite directions.

* * * * *